United States Patent [19]

Stehr

[11] Patent Number: 4,739,936

[45] Date of Patent: Apr. 26, 1988

[54] CLOSED AGITATOR MILL WITH SCREEN CARTRIDGES

[75] Inventor: Norbert Stehr, Mannheim, Fed. Rep. of Germany

[73] Assignee: Draiswerke GmbH, Mannheim, Fed. Rep. of Germany

[21] Appl. No.: 796,189

[22] Filed: Nov. 8, 1985

[30] Foreign Application Priority Data

Nov. 16, 1984 [DE] Fed. Rep. of Germany ..... 3441871

[51] Int. Cl.[4] ..... B02C 17/16

[52] U.S. Cl. ..... 241/69; 241/171; 241/172

[58] Field of Search ..... 241/69, 70, 180, 171, 241/172, 300, 46.11, 46.17; 210/173, 174, 433.1, 434; 209/250, 273, 281, 283

[56] References Cited

U.S. PATENT DOCUMENTS 3,185,398 5/1965 Hughes et al. ..... 241/171 X
3,780,957 12/1973 Wilhelm ..... 241/172
4,582,266 4/1986 Entrikin et al. ..... 241/172

FOREIGN PATENT DOCUMENTS 2154059 5/1973 Fed. Rep. of Germany ..... 241/172
3036280 5/1982 Fed. Rep. of Germany ..... 241/172

*Primary Examiner*—Mark Rosenbaum
*Attorney, Agent, or Firm*—Browdy and Neimark

[57] ABSTRACT

A closed agitator mill for grinding and mixing solids in liquids has a grinding space partially filled with auxiliary grinding elements, in which an agitator mechanism that can be driven at high speed is located; the agitator mechanism comprises an agitator shaft and agitator tools attached to it and generates a flow of grinding stock and auxiliary grinding bodies. At least one tubular screen cartridge, which is interchangeable from outside, is disposed before a ground stock outlet from the grinding space. The screen cartridge protrudes into the space between the agitator shaft and the wall of the grinding space and serves to separate the auxiliary grinding elements from the grinding stock. In order to attain satisfactory, substantially wear-free separation of the grinding stock and the auxiliary grinding elements even when the material to be ground is highly viscous and/or with high throughput, the screen cartridge has a cross section the extension of which is longer, in the flow direction of the flow of grinding stock and auxiliary grinding elements in the grinding space, than at right angles to the flow direction.

3 Claims, 4 Drawing Sheets

CLOSED AGITATOR MILL WITH SCREEN CARTRIDGES

FIELD OF THE INVENTION

The invention relates to a closed agitator mill for grinding and mixing solids in liquids, having a grinding space partially filled with auxiliary grinding elements. Located in the grinding space is an agitator mechanism comprising an agitator shaft and attached agitator tools, which mechanism is drivable at high speed and generates a flow of grinding stock and auxiliary grinding elements. A grinding stock inlet opens into the grinding space, and a ground stock outlet opens out from the grinding space, and at least one tubular screen cartridge which is interchangeable from outside is disposed in front of the ground stock outlet. The screen cartridge protrudes into the space between the agitator shaft and the grinding space wall and separates the auxiliary grinding elements from the grinding stock.

BACKGROUND OF THE INVENTION

Agitator mills of this kind, disclosed in U.S. Pat. No. 3,780,957), have circular-cylindrical screen cartridges. They have long since proved to be extraordinarily reliable in use and to have a wide range of applications, because the screen cartridges are readily interchangeable. In practice, however, it has proved disadvantageous that, particularly when the material to be ground is highly viscous, the grinding output of such an agitator mill drops, and the grinding stock becomes heated to an unacceptable extent. At the same time, the auxiliary grinding elements undergo increased breakage. In such agitator mills, the auxiliary grinding elements typically are of glass, sintered $Al_2O_3$ or zirconium oxide. Comparable problems arise when low-viscosity material is to be ground if the throughput capacity is to be increased sharply, that is, if there is a throughput of relatively large quantities per unit of time. In addition to the above problems, complete blockage of the agitator mill occurs frequently, so that practically no throughput is accomplished.

SUMMARY OF THE INVENTION

It is accordingly a principal object of the present invention to embody an agitator mill of the above generic type such that even when highly viscous material is to be ground and/or when high throughput capacity is needed, a satisfactory, largely wear-free separation of the grinding stock and the auxiliary grinding elements is obtained.

This object is attained in accordance with the invention by providing that the cross section of the screen cartridge has a longer extension in the flow direction in the grinding space than at right angles thereto. Because the screen cartridge or cartridges are given a cross section which is particularly favorable hydrodynamically, the flow of grinding stock and auxiliary grinding elements around the screen cartridges is uninterrupted; that is, no dead zones form behind the screen cartridge—with respect to the flow direction—in which a compacted mass of grinding material and auxiliary grinding bodies remains stationary. Thus the entire surface area of the screen cartridge is available for separating the grinding stock from the auxiliary grinding elements. Wear of the auxiliary grinding bodies against the screen cartridge is sharply reduced. The embodiment according to the invention is particularly economical in terms of space; it is therefore possible for agitator tools to be disposed on both sides of the screen cartridge or cartridges, which are disposed in the vicinity of the bottom or top of the grinding space, so that the increased shear speed between the agitator tools on either side and the screen cartridge tends to effect even further prevention of substantially static concentrations of auxiliary grinding bodies on the rear side—as seen in the flow direction—of the screen cartridge.

In a favorable feature of the invention, the cross-sectional extension of the screen cartridges is preferably twice as long in the flow direction as it is at right angles thereto. If the screen cartridge experiences a flow from both sides—as is typically the case—then it is useful for it to have a doubly symmetrical elliptical cross section. If the screen cartridge experiences a flow from only one side, then it may have a teardrop-shaped cross section.

By tapering the screen cartridge at its closed end, the flow is divided at the bottom of the screen cartridge as well, which promotes a better flow around the screen cartridge.

An inlay of hard-elastic material on the forward edge of the screen cartridge reduces wear both of this edge and of the auxiliary grinding elements themselves. Locating the screen cartridges between two agitator disks spaced apart from one another in the longitudinal direction of the agitator shaft assures that the flow of grinding stock and auxiliary grinding elements is maintained on both sides of a given screen cartridge. A particularly wear-free embodiment is attained if the forward edge of the screen cartridge is provided with a supporting and wear-preventing strip of highly wear-resistant metal. Especially if two such strips are arranged parallel and screen walls are attached to them, the screen surfaces themselves are no longer acted upon by the auxiliary grinding elements. This is particularly true if the screen walls are made parallel to one another as well. The effect attained by tapering the closed end of the screen cartridge is particularly favorable if the screen cartridge ends at the agitator shaft.

Further advantages and features of the invention will become apparent from the ensuing description of exemplary embodiments of the invention, referring to the drawings.

DESCRIPTION OF THE PREFERRED EMBODIMENTS

Figure 1:
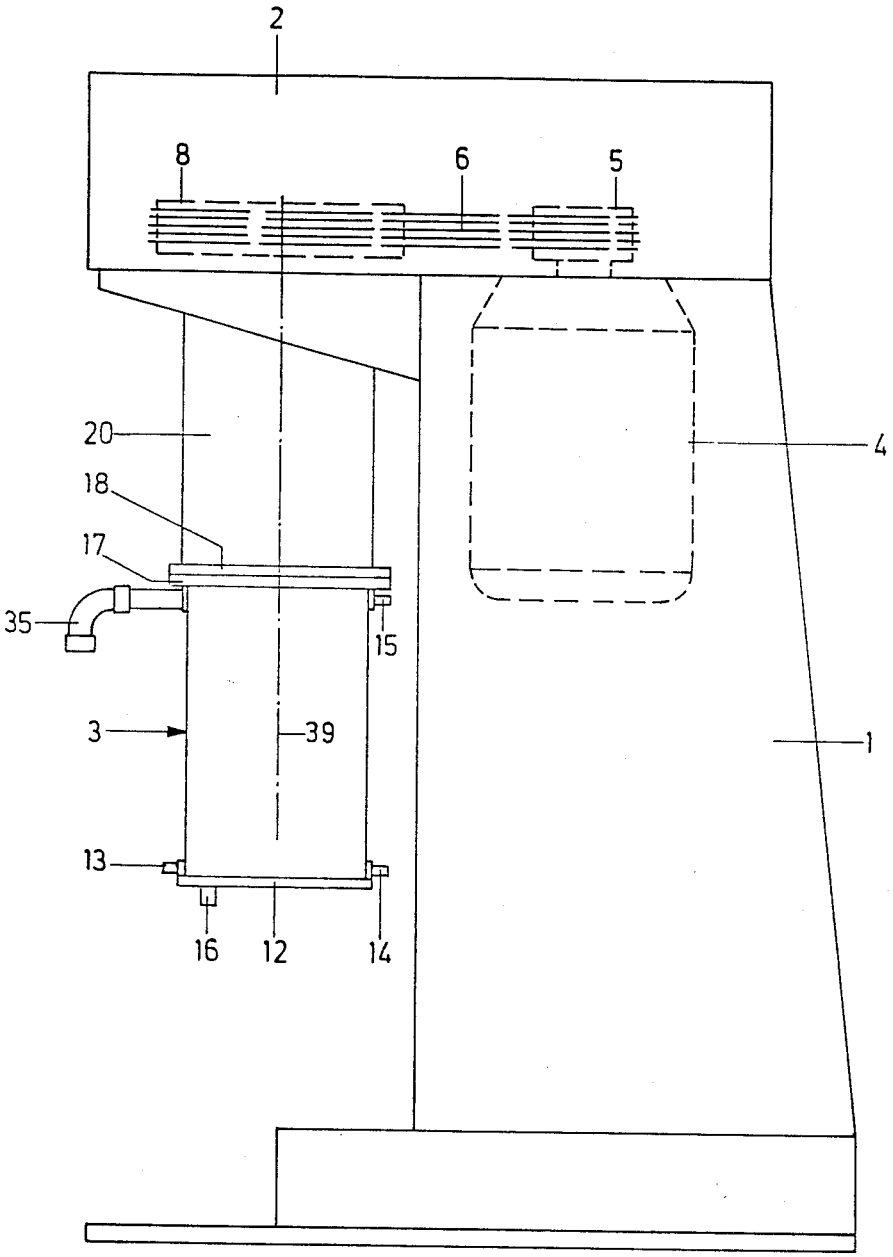
FIG. 1, in schematic form, shows an upright agitator mill.

The agitator mill shown in the drawing has a stand 1 in the conventional manner, on the top of which a cantilevered support arm 2 is disposed, to which a cylindrical grinding container 3 is in turn secured. An electric drive motor 4 is housed in the stand 1 and is provided with a V-belt pulley 5, which via V belts 6 drives a V-belt pulley 8 so that it rotates; the pulley 8 is joined in a rotationally fixed manner with an agitator mechanism 7.

The grinding container 3 comprises a cylindrical inner cylinder 10 which surrounds a grinding space 9 and at the same time forms the wall of the grinding container. The inner cylinder 10 is in turn surrounded by a cooling jacket 11 which is also substantially cylindrical. The grinding space 9 and the cooling jacket 11 are closed off at the bottom by a bottom plate 12, which is secured to the inner cylinder 10 and the cooling jacket 12, for instance by welding. A grinding stock feed pipe 13 is attached to the bottom plate 12; through it, grinding stock can be pumped into the grinding space 9 from below. A lower coolant inlet pipe 14 and an upper coolant outlet pipe 15 are provided on the cooling jacket 11. An outlet pipe 16 for auxiliary grinding elements is also provided in the bottom plate 12.

Figure 2:
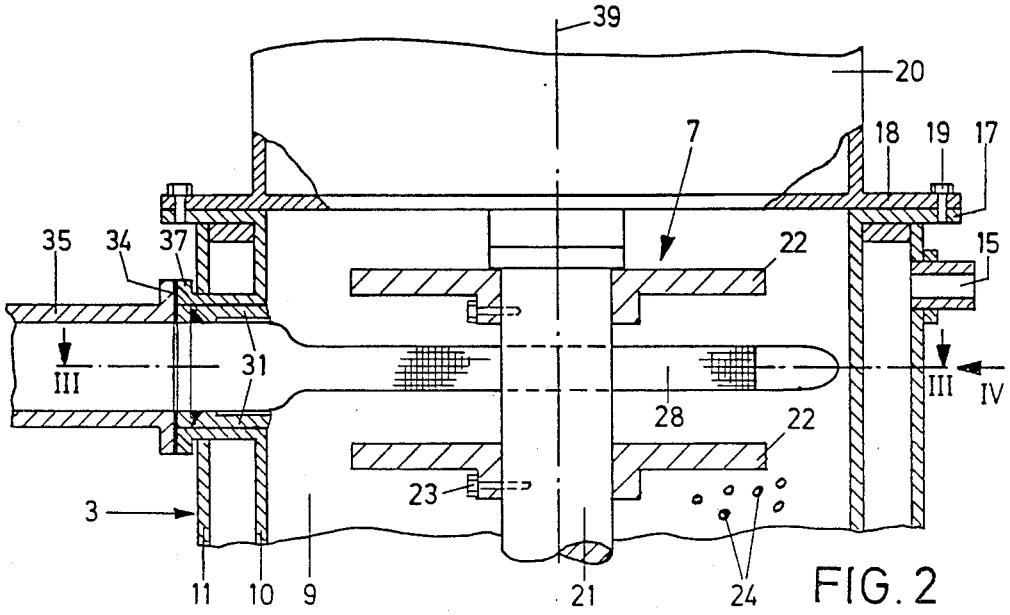
FIG. 2 is a sectional view of the upper end of the grinding container of the agitator mill having the screen cartridge.
Figure 3:
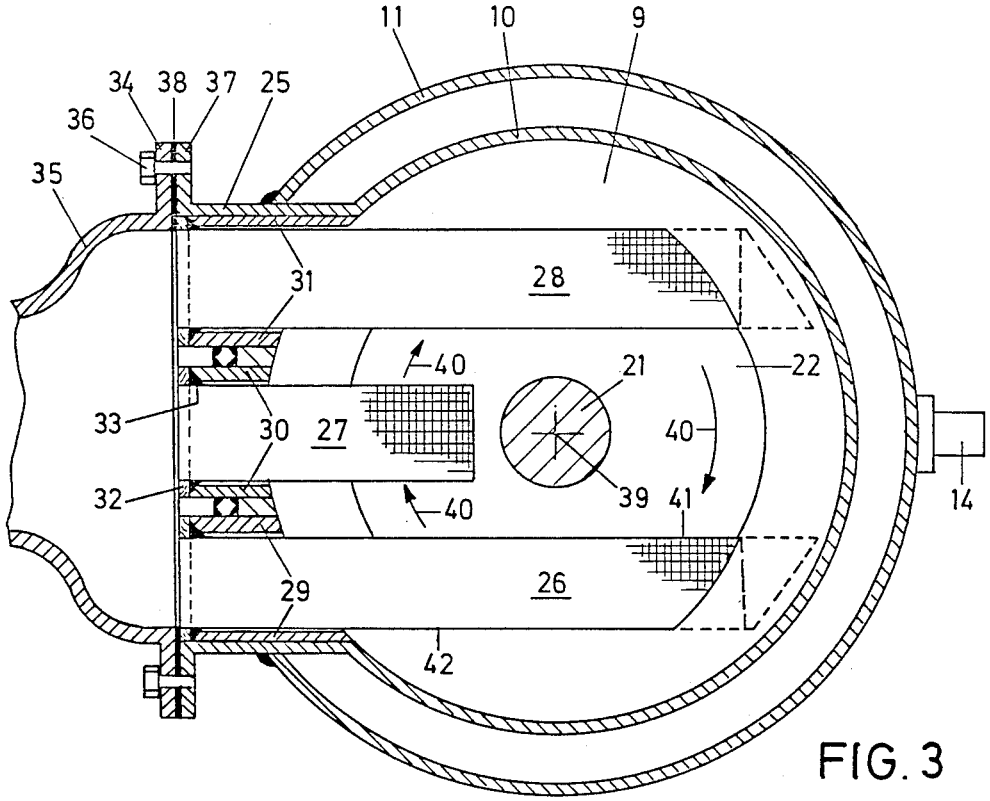
FIG. 3 is a vertical section taken through the grinding container along the line III—III of FIG. 2.

The grinding container 3 has an upper annular flange 17, by means of which the grinding container is secured with screws 19 to a cover 18 closing off the grinding space 9. This cover 18 is attached to the underside of a supporting housing 20, which is secured with its upper end to the support arm 2 of the agitator mill. An agitator shaft 21 making up a substantial portion of the agitator mechanism 7 is supported in the supporting housing 20 in the usual manner, for instance as known from U.S. Pat. No. 4,129,261. The agitator shaft 21 extends to the outside through the cover 18 in a sealed manner, as also known from the above patent. Agitator disks 22 are secured, for instance by means of screws 23, on the agitator shaft 21 spaced axially apart from one another. The grinding space 9 is from 50% to 70% filled with auxiliary grinding bodies 24, which have a diameter of from 0.2 to 3.0 mm. The grinding stock is fed into the grinding space 9 through the grinding stock feed pipe 13 and after being ground leaves the grinding space through a ground stock outlet pipe 25. Connected to this ground stock outlet pipe 25, in the exemplary embodiment of FIGS. 2 and 3, are three screen cartridges 26, 27, 28. These screen cartridges 26–28 are disposed in respective sleeves 29, 30, 31, which penetrate the cooling jacket 11 in the vicinity of the cover 18. The screen cartridges 26–28 rest with respective flanges 32, with a ring seal 33 being interposed, against the upper rims of the sleeves 29–31. They are retained in this position by a connecting flange 34 of a drain line 35. The connecting flange 34 is releasably joined by means of screws 36 to a corresponding connecting flange 37 of the ground stock outlet pipe 25, with a seal 38 being interposed; this connecting flange 37 is disposed on the ground stock outlet pipe 25 that receives the sleeves 29–31.

Figure 4:
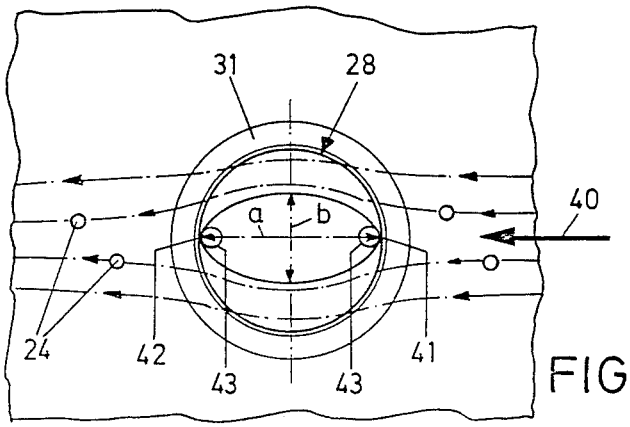
FIG. 4 is an end view of a screen cartridge in the direction of the arrow IV of FIG. 2.

The two outer screen cartridges 26, 28 extend laterally past the agitator shaft 21, while the middle screen cartridge 27 is shorter and extends to just before the agitator shaft 21. The screen cartridges 26–28 are disposed between two agitator disks 22 adjacent to one another in the direction of the central longitudinal axis 39 of the agitator mechanism 7, so that a compulsory flow of grinding stock and auxiliary grinding bodies is maintained in the region between these two agitator disks. As shown in FIGS. 2 and 4, the screen cartridges 26–28 have a streamlined cross section in the region located in the grinding space. As shown particularly clearly in FIG. 4, the streamlined cross section is provided by providing the screen cartridges 26–28 with an elliptical cross section, wherein the long axis a is at least twice as long as the short axis b. In other words, $b \leqq 0.5$ a.

The flow of grinding stock and auxiliary grinding bodies extends substantially in the direction of rotation of the agitator mechanism 7, that is as indicated by the arrows 40. The screen cartridges are arranged such that the long axes a of their tapered cross section extend approximately in the direction of the flow-indicating arrows 40. In the embodiment according to FIGS. 1–3, in which the longitudinal direction of the screen cartridges 26–28 extends approximately at right angles to the central longitudinal axis 39, the respective short axes b extend approximately parallel to the axis 39. If—as is known from U.S. Pat. No. 3,780,957— the screen cartridges extend into the grinding space from the cover parallel to the central longitudinal axis, then the long axes a also extend in the flow direction, that is, at a tangent to the agitator mechanism, while the short axes b extend approximately radially with respect to the agitator mechanism.

The screen cartridges 26–28 substantially comprise conventional sheet-metal screens, the openings of which are smaller than the smallest auxiliary grinding body 24 used.

Only for the screen cartridge 26 is it shown that this element has an inlay 43 of elastic material, such as hard rubber, on its respective forward edge 41 or 42, a provision which sharply reduces the wear of the screen cartridge 26 in the vicinity of this forward edge 41 or 42, against which the auxiliary grinding bodies 24 flowing toward it in the flow direction 40 strike the hardest. Since, as FIG. 3 shows, both edges of at least the two screen cartridges 26, 28 disposed laterally of the agitator shaft 21 serve as forward edges 41 or 42 over a portion of their length, it is appropriate to provide these inlays 43 over the entire length of the screen cartridges located in the grinding space 9.

As also shown in FIG. 3, the two screen cartridges 26 and 28 located laterally of the agitator shaft 21 are extended up to just before the inner cylinder 10 defining the grinding space 9, so that virtually all the grinding stock moved through this cross section of the grinding space 9 comes into contact with the screen cartridges 26, 28. Furthermore, as shown in FIG. 2, the screen cartridges 26 and 28 can be tapered at their closed ends, by further reducing the length of the short axis b, which particularly facilitates changing them when the screen cartridges that are to be put back in have to be inserted into an auxiliary grinding body packet. This is particularly the case if the grinding containers are disposed horizontally, with the remainder of the apparatus having the same embodiment as that described above. This arrangement is known for instance from British Patent No. 1,049,685.

Figure 5:
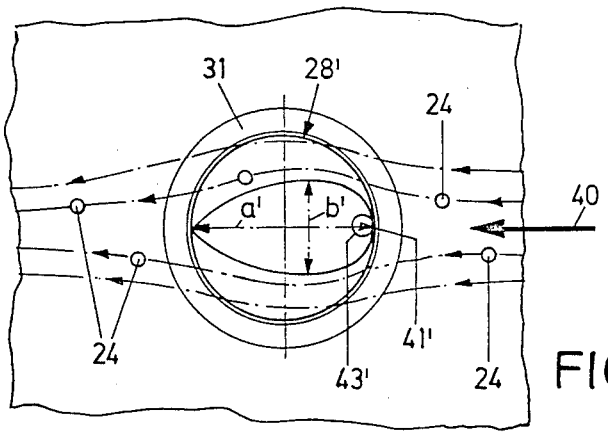
FIG. 5 shows a modified embodiment of a screen cartridge in a view corresponding to FIG. 4.

FIG. 5 shows the ideal profile in terms of streamlining; that is, the screen cartridge 28' has a teardrop-shaped cross section; once again, however, the long axis a' extending in the flow direction 40 is at least twice as long as the short axis b' extending at right angles thereto, and which is formed by the maximum thickness of the profile transverse to the flow direction 40. Such a profile is somewhat more complicated to manufacture than the profile shown in FIG. 4. Also, it can be favorably used only if the flow over the entire length of the screen cartridge 28' arrives only from one direction, that is, if there is only one forward edge 41', which can then of course be provided with an inlay 43'.

The agitator disks 22 typically have perforations, in a known manner. Instead of the agitator disks, agitator arms can be used as agitator tools, for instance as known from U.S. Pat. No. 4,129,261.

In many cases, the middle screen cartridge 27 will be omitted entirely in practical embodiments of the agitator mill shown in the drawing. If it is included, it can be provided with the cross section shown in FIG. 5, because in the case of radially arranged screen cartridges, the flow is directed against only one forward edge.

Figure 6:
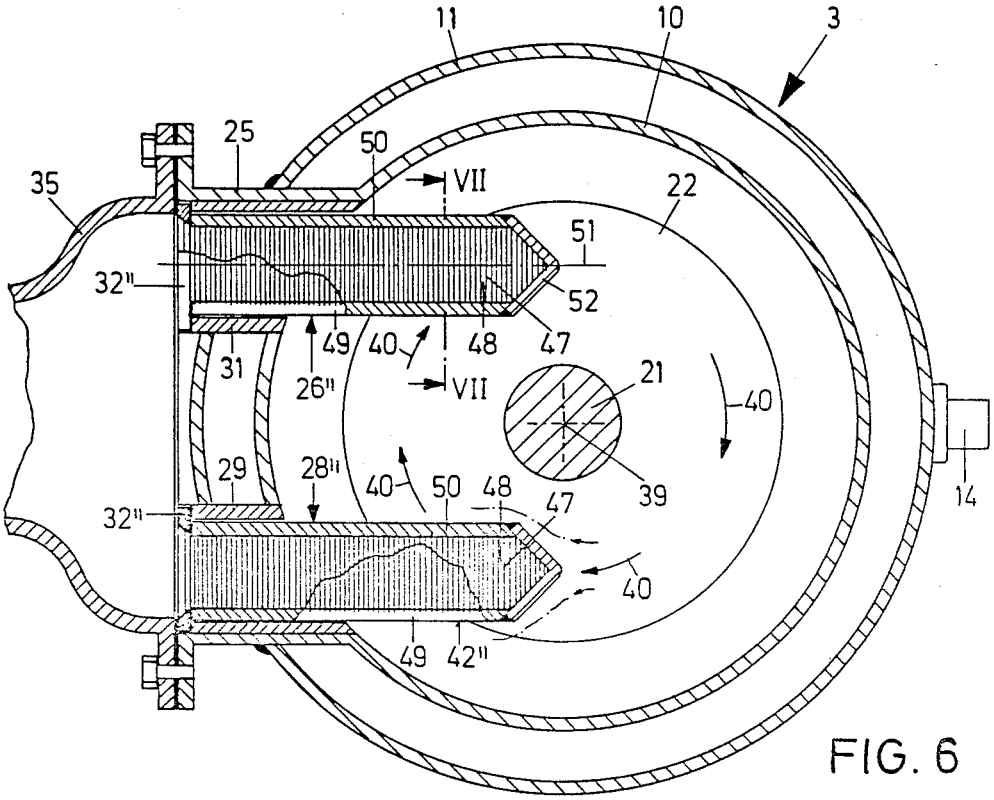
FIG. 6 is a horizontal section taken through the grinding container, with a modified screen cartridge.
Figure 7:
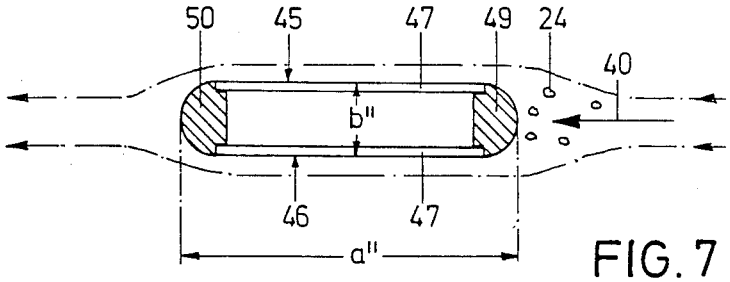
FIG. 7 is a section taken through the screen cartridge along the line VII—VII of FIG. 6.

In the exemplary embodiment of FIGS. 6 and 7, elements having the same function are identified with the same reference numerals as before, but with a double prime.

Two screen cartridges 26'', 28'' are provided, which are disposed between the agitator disks 22. They each end approximately in the vertical central plane of the grinding container 3, which is disposed at right angles to the longitudinal direction of the screen cartridges. The screen cartridges have parallel screen walls 45, 46, which comprise narrow metal bands 47 extending parallel to one another, between which there are screen slits 48, which are again smaller than the diameter of the smallest auxiliary grinding bodies 24 used. These metal bands 47 are welded to supporting and wear-preventing strips 49, 50, which likewise extend parallel to and spaced apart from one another. The outer spacing a'' between the two strips 49, 50 represents the long half-axis of the screen cartridges 26'', 28'', while the vertical spacing of the metal bands 47 determines the short half-axis b''. As shown by the crosssectional illustration of a supporting and wear-preventing strip 49 in FIG. 7, this strip substantially comprises a highly wear-resistant metal, for instance an appropriately high-alloy steel. The auxiliary grinding bodies 40, in accordance with the flow direction 40, strike solely against the strip 49 that is on the forward side in terms of the flow direction 40. The screen walls 45, 46 are not restricted by the auxiliary grinding bodies 24 in any way, because the flow extends entirely parallel to them.

As shown by FIGS. 6 and 7, the screen cartridges 26'', 28'' are symmetrically tapered at their ends; that is, they extend to a sharp point transversely to their long half-axis a'', toward their central longitudinal axis 51. This region is again closed off by a supporting and wear-preventing strip 52 corresponding in cross section to the strips 49, 50. Taken together with the end of the screen cartridge 26'' or 28'', this provision means that the flow of grinding stock and auxiliary grinding bodies striking this pointed tip approximately perpendicularly as indicated by the arrow 40 is divided, and flows along both long edges of the cartridges as embodied by the strips 49, 50, or along their screen walls 45, 46. Thus as a result of this supporting and wear-preventing strip 52, an extraordinarily streamlined and wear-resistant bottom is provided for the screen cartridge 26'' or 28''. The screen cartridges 26'', 28'' also have a flange 32'', which is fastened in place in the same sealed manner as in the exemplary embodiments described in conjunction with FIGS. 2–5. The supporting and wear-prevening strip 49 located forward in terms of the flow direction 40 forms the corresponding forward edge 42''.

What is claimed is:

1. A closed agitator mill for grinding and mixing solids in liquids comprising:

a grinding space in which is located an agitator means, said grinding space being partially filled with auxiliary grinding elements;

said agitator means comprising an agitator shaft and agitator tools attached to said agitator shaft, said agitator means being drivable at high speed, and said agitator means generating a flow of grinding stock and auxiliary grinding elements;

a grinding stock inlet opening into the grinding space;

a ground stock outlet opening out from the grinding space;

at least one tubular screen cartridge, which is interchangeable from the outside of the mill, located within the grinding space upstream of the ground stock outlet and protruding along its length into a space between the agitator shaft and the grinding space wall to separate the auxiliary grinding elements from the grinding stock;

said screen cartridge having in cross section one long dimension and one small dimension, said dimensions being at right angles to each other and the long dimension being at least twice as long as the small dimension, the dimensions being maintained in the mill in such fashion that the long dimension substantially extends in the direction of flow of liquid and solids through said mill, and said small dimension extending at right angles to the flow direction;

two supporting and wear-preventing strips of wear reducing material parallel to one another located on the edges of the screen cartridge and extending the length of said screen cartridge along the small dimension, one of said strips facing in the flow direction; and two screen walls extending the length of said screen cartridge along the long dimension and secured to said strips, wherein the screen cartridge is tapered on its closed end.

2. An agitator mill as defined by claim 1, wherein the screen cartridge terminates at the agitator shaft (21).

3. A closed agitator mill for grinding and mixing solids in liquids, having a grinding space (9) partially filled with auxiliary grinding elements, in which an agitator mechanism (7) comprising an agitator shaft (21) and agitator tools attached thereto is disposed which is drivable at high speed and generates a flow of grinding stock and auxiliary grinding elements, wherein a grinding stock inlet (13) opens into the grinding space (9) and a ground stock outlet (25) opens out from the grinding space, and at least one tubular screen cartridge (26, 27, 28; 28', 26'', 28''), which is interchangeable from outside, is disposed before the ground stock outlet and protrudes into the space between the agitator shaft (21) and the grinding space wall (10) and serves to separate the auxiliary grinding elements (24) from the grinding stock characterized in that the screen cartridge (26, 27, 28; 28', 26'', 28'') has one long cross section (a) and a small cross section (b) perpendicular to one another, the long cross section being at least twice as long as the small cross section, the screen cartridge being fixed in the mill in such a way that the long cross section substantially extends in the flow direction (40) in the grinding space (9) of grinding stock and auxiliary grinding elements with the small cross section (b) being at substantially a right angle to the flow direction (40); wherein on its forward edge (42''), the screen cartridge (26'', 28'') has a supporting and wear-preventing strip

(49) of highly wear-resistant metal, the screen cartridge having another wear-preventing strip (50) parallel to the first mentioned wear-preventing strip (49), two screen walls (45, 46) being secured to these wear-preventing strips (49, 50), wherein the two screen walls of said screen cartridge extend parallel to one another; and said screen cartridge is tapered at its closed end and projects radially into the interior of said agitator mill.

* * * * *